US006839932B2

(12) United States Patent
Huang

(10) Patent No.: US 6,839,932 B2
(45) Date of Patent: Jan. 11, 2005

(54) BATH BALL AND METHOD OF MAKING A BATH BALL

(76) Inventor: Min-Tsung Huang, 58, Ma Yuan West St., Taichung (TW)

( * ) Notice: Subject to any disclaimer, the term of this patent is extended or adjusted under 35 U.S.C. 154(b) by 27 days.

(21) Appl. No.: 10/448,094

(22) Filed: May 27, 2003

(65) Prior Publication Data

US 2004/0237237 A1 Dec. 2, 2004

(51) Int. Cl.[7] ..... A47L 13/10
(52) U.S. Cl. ..... 15/229.11; 15/209.1; 15/229.13
(58) Field of Search ..... 15/209.1, 229.11, 15/210.1, 229.12, 229.13, 229.14; 300/21

(56) References Cited

U.S. PATENT DOCUMENTS 6,105,196 A * 8/2000 Chang ..... 15/209.1
6,131,234 A * 10/2000 Chen ..... 15/229.11
6,676,222 B2 * 1/2004 Hsu ..... 300/21
2003/0196287 A1 * 10/2003 Chen ..... 15/118
2004/0000019 A1 * 1/2004 Chang ..... 15/209.1

* cited by examiner

*Primary Examiner*—Terrence R. Till
*Assistant Examiner*—S Balsis

(57) ABSTRACT

A bath ball has an elastic tube-shaped net, a thread girdle surrounding the elastic tube-shaped net in an 8 shape radially, the thread girdle having a first end and a second end, the first end and the second end of the thread girdle forming a connecting knot, the connecting knot moved inside the elastic tube-shaped net, the thread girdle being pulled and the elastic tube-shaped net being squeezed, a single running knot formed on the thread girdle, and the thread girdle being pulled again to form a noose.

6 Claims, 3 Drawing Sheets

BATH BALL AND METHOD OF MAKING A BATH BALL

BACKGROUND OF THE INVENTION

The present invention relates to a bath ball. More particularly, the present invention relates to a method of making a bath ball.

U.S. Pat. No. 6,105,196 has disclosed a bath ball having an elastic tube-shaped net, two girdles, and a ring enclosing the bath ball. Since the ring is not fixed on the bath ball stably, the ring will be slided while a user uses the bath ball. Furthermore, the bath ball is very puffy and fluffy so that a cleaning effect is not good.

SUMMARY OF THE INVENTION

An object of the present invention is to provide a bath ball which has an elastic tube-shaped net and a thread girdle in order to reduce required elements while making the bath ball.

Another object of the present invention is to provide a bath ball which has a noose becoming a portion of a thread girdle so that the noose will not slide while a user uses the bath ball.

Another object of the present invention is to provide a bath ball which has an elastic tube-shaped net to form a ball-shaped article with an even density.

Accordingly, a bath ball comprises an elastic tube-shaped net, a thread girdle surrounding the elastic tube-shaped net in an 8 shape radially, the thread girdle having a first end and a second end, the first end and the second end of the thread girdle forming a connecting knot, the connecting knot moved inside the elastic tube-shaped net, the thread girdle being pulled and the elastic tube-shaped net being squeezed, a single running knot formed on the thread girdle, and the thread girdle being pulled again to form a noose.

A method of making the bath ball comprises steps of:

the elastic tube-shaped net surrounding four posts and the posts disposed on a plate, the elastic tube-shaped net compressed downward, the thread girdle surrounding the elastic tube-shaped net in an 8 shape radially, and the first end and the second end of the thread girdle forming the connecting knot, the connecting knot moved inside the elastic tube-shaped net, the elastic tube-shaped net removed from the posts, the thread girdle being pulled and the elastic tube-shaped net being squeezed to form a ball-shaped article, the single running knot formed on the thread girdle, and the thread girdle being pulled again to form the noose.

DETAILED DESCRIPTION OF THE INVENTION

Figure 1:
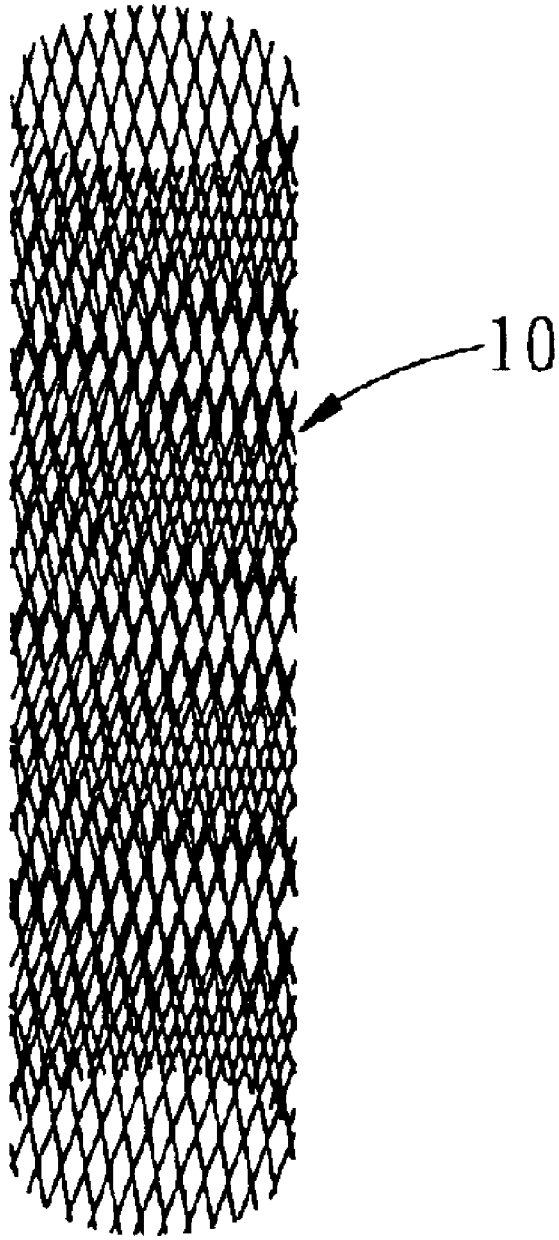
FIG. 1 is a perspective view of a tube-shaped elastic net of a preferred embodiment in accordance with the present invention.

Referring to FIG. 1, a tube-shaped elastic net 10 has a large number of meshes.

Figure 2A:
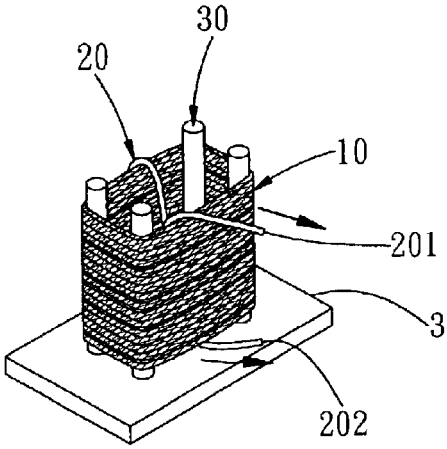
FIG. 2*a* is a perspective schematic view illustrating a first step of making a bath ball of a preferred embodiment in accordance with the present invention.
Figure 2D:
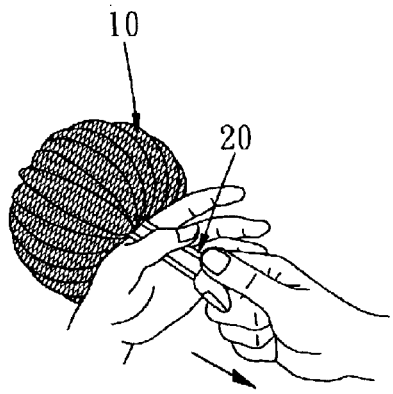
FIG. 2*d* is a perspective schematic view illustrating a fourth step of making a bath ball of a preferred embodiment in accordance with the present invention.
Figure 2B:
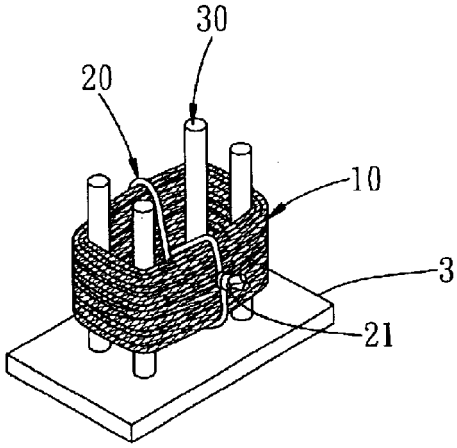
FIG. 2*b* is a perspective schematic view illustrating a second step of making a bath ball of a preferred embodiment in accordance with the present invention.
Figure 2E:
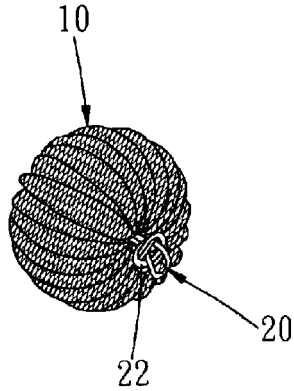
FIG. 2*e* is a perspective schematic view illustrating a fifth step of making a bath ball of a preferred embodiment in accordance with the present invention.
Figure 2C:
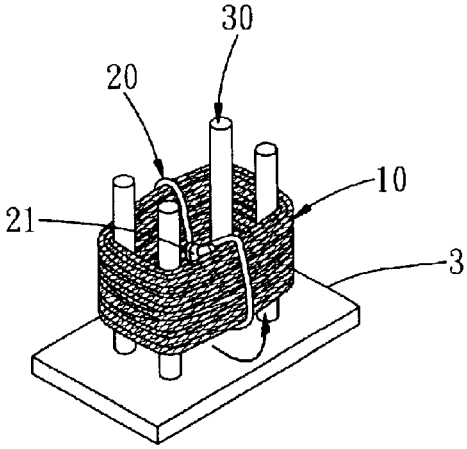
FIG. 2*c* is a perspective schematic view illustrating a third step of making a bath ball of a preferred embodiment in accordance with the present invention.
Figure 2F:
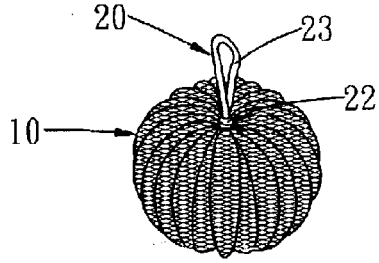
FIG. 2*f* is a perspective view of a bath ball of a preferred embodiment in accordance with the present invention.
Figure 3A:
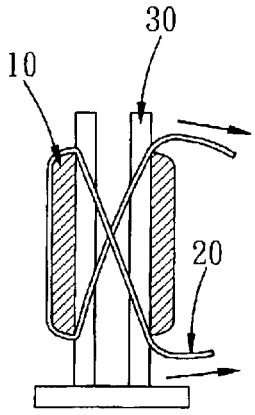
FIG. 3*a* is a sectional schematic view illustrating a first step of making a bath ball of a preferred embodiment in accordance with the present invention.
Figure 3D:
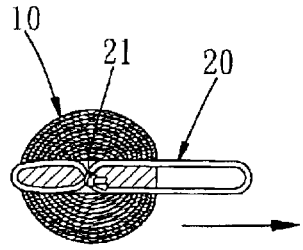
FIG. 3*d* is a sectional schematic view illustrating a fourth step of making a bath ball of a preferred embodiment in accordance with the present invention.
Figure 3B:
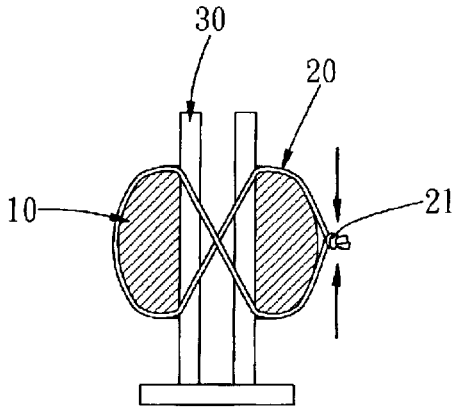
FIG. 3*b* is a sectional schematic view illustrating a second step of making a bath ball of a preferred embodiment in accordance with the present invention.
Figure 3E:
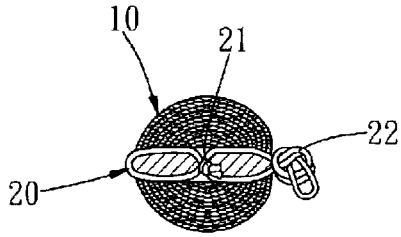
FIG. 3*e* is a sectional schematic view illustrating a fifth step of making a bath ball of a preferred embodiment in accordance with the present invention.
Figure 3C:
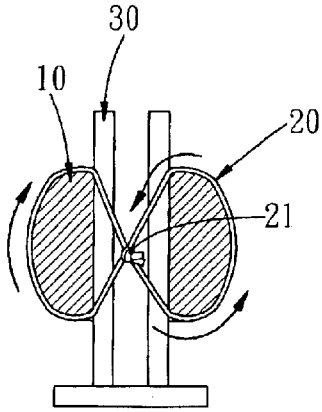
FIG. 3*c* is a sectional schematic view illustrating a third step of making a bath ball of a preferred embodiment in accordance with the present invention.
Figure 3F:
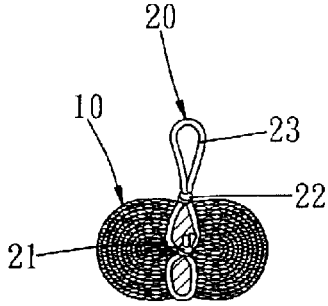
FIG. 3*f* is a sectional view of a bath ball of a preferred embodiment in accordance with the present invention.

Referring to FIGS. 2*f* and 3*f*, a bath ball comprises an elastic tube-shaped net 10, a thread girdle 20 surrounding the elastic tube-shaped net 10 in an 8 shape radially, the thread girdle 20 having a first end 201 and a second end 202, the first end 201 and the second end 202 of the thread girdle 20 forming a connecting knot 21, the connecting knot 21 moved inside the elastic tube-shaped net 10, the thread girdle 20 being pulled and the elastic tube-shaped net 10 being squeezed, a single running knot 22 formed on the thread girdle 20, and the thread girdle 20 being pulled again to form a noose 23.

The elastic tube-shaped net 10 is made of a plastics material.

The thread girdle 20 is made of a flexible material.

Referring to FIGS. 2*a* to 2*f* and 3*a* to 3*f*, a method of making the bath ball comprises steps of:

the elastic tube-shaped net 10 surrounding four posts 30 and the posts 30 disposed on a plate 3, the elastic tube-shaped net 10 compressed downward, the thread girdle 20 surrounding the elastic tube-shaped net 10 in an 8 shape radially, and the first end 201 and the second end 202 of the thread girdle 20 forming the connecting knot 21, the connecting knot 21 moved inside the elastic tube-shaped net 10, the elastic tube-shaped net 10 removed from the posts 30, the thread girdle 20 being pulled and the elastic tube-shaped net 10 being squeezed to form a ball-shaped article, the single running knot 22 formed on the thread girdle 20, and the thread girdle 20 being pulled again to form the noose 23.

The present invention has the following advantages.

The bath ball has the elastic tube-shaped net and the thread girdle in order to reduce required elements while making the bath ball.

The noose becomes a portion of the thread girdle so that the noose will not slide while a user uses the bath ball.

The elastic tube-shaped net forms a ball-shaped article with an even density.

The present invention is not limited to the above embodiment but various modification thereof may be made. Furthermore, various changes in form and detail may be made without departing from the scope of the present invention.

I claim:

1. A bath ball comprising:

an elastic tube-shaped net, a thread girdle surrounding the elastic tube-shaped net in an eight shape radially, the thread girdle having a first end and a second end, the first end and the second end of the thread girdle forming a connecting knot, the connecting knot moved inside the elastic tube-shaped net, the thread girdle being pulled and the elastic tube-shaped net being squeezed, a single running knot formed on the thread girdle, and the thread girdle being pulled again to form a noose.

2. The bath ball as claimed in claim 1, wherein the elastic tube-shaped net is made of a plastics material.

3. The bath ball as claimed in claim 1, wherein the thread girdle is made of a flexible material.

4. A method of making the bath ball comprising steps of:

an elastic tube-shaped net surrounding four posts and the posts disposed on a plate, the elastic tube-shaped net compressed downward, a thread girdle surrounding the elastic tube-shaped net in an eight shape radially, and a first end and a second end of the thread girdle forming a connecting knot, the connecting knot moved inside the elastic tube-shaped net, the elastic tube-shaped net removed from the posts, the thread girdle being pulled and the elastic tube-shaped net being squeezed to form a ball-shaped article, a single running knot formed on the thread girdle, and the thread girdle being pulled again to form a noose.

5. The bath ball as claimed in claim 4, wherein the elastic tube-shaped net is made of a plastics material.

6. The bath ball as claimed in claim 4, wherein the thread girdle is made of a flexible material.

* * * * *